US006026795A

United States Patent [19]

Poggio et al.

[11] Patent Number: 6,026,795

[45] Date of Patent: Feb. 22, 2000

[54] ELECTRONIC DEVICE FOR CONTROLLING THE AIR/FUEL RATIO OF THE MIXTURE SUPPLIED TO AN INTERNAL-COMBUSTION ENGINE

[75] Inventors: Luca Poggio, Spinetta Marengo; Giorgio Bombarda, S. Lazzaro di Savena; Marco Secco, Nizza Monferrato, all of Italy

[73] Assignee: Magneti Marelli S.P.A., Milan, Italy

[21] Appl. No.: 09/116,653

[22] Filed: Jul. 16, 1998

[30] Foreign Application Priority Data

Jul. 18, 1997 [IT] Italy ..... TO97A0652

[51] Int. Cl.[7] ..... F02M 25/00

[52] U.S. Cl. ..... 123/695; 123/696

[58] Field of Search ..... 123/694, 695, 123/696

[56] References Cited

U.S. PATENT DOCUMENTS

| | | | |
|---|---|---|---|
| 5,435,290 | 7/1995 | Gopp et al. | 123/694 |
| 5,473,889 | 12/1995 | Ehard et al. | 60/276 |
| 5,692,487 | 12/1997 | Schuerz et al. | 123/696 |
| 5,787,867 | 8/1998 | Schnaibel et al. | 123/696 |
| 5,836,153 | 11/1998 | Staufenberg et al. | 123/696 |
| 5,867,983 | 2/1999 | Otani | 123/696 |

OTHER PUBLICATIONS

Patent Abstracts of Japan of JP 63223347 of Sep., 1988.
Patent Abstracts of Japan of JP 63223346 of Sep., 1988.

*Primary Examiner*—John Kwon
*Attorney, Agent, or Firm*—Ladas & Parry

[57] ABSTRACT

Control device in which a linear oxygen sensor arranged on a gas exhaust pipe of an internal-combustion engine upstream of a catalytic converter generates a signal supplied to a conversion circuit generating at its output a measured parameter representing the air/fuel ratio of the mixture supplied to the engine. The measured parameter is compared with a target parameter so as to calculate an error parameter which is used, according to an operating method, to generate, where necessary, a bistable dummy signal variable between a positive saturation value and a negative saturation value so as to model the output of an oxygen sensor of the ON/OFF type. The dummy signal is also processed so as to calculate a correction parameter designed to be used for correction of a theoretical value of a calculated quantity of fuel, obtaining a corrected quantity of fuel for an injection system of the engine.

10 Claims, 2 Drawing Sheets

Fig. 2
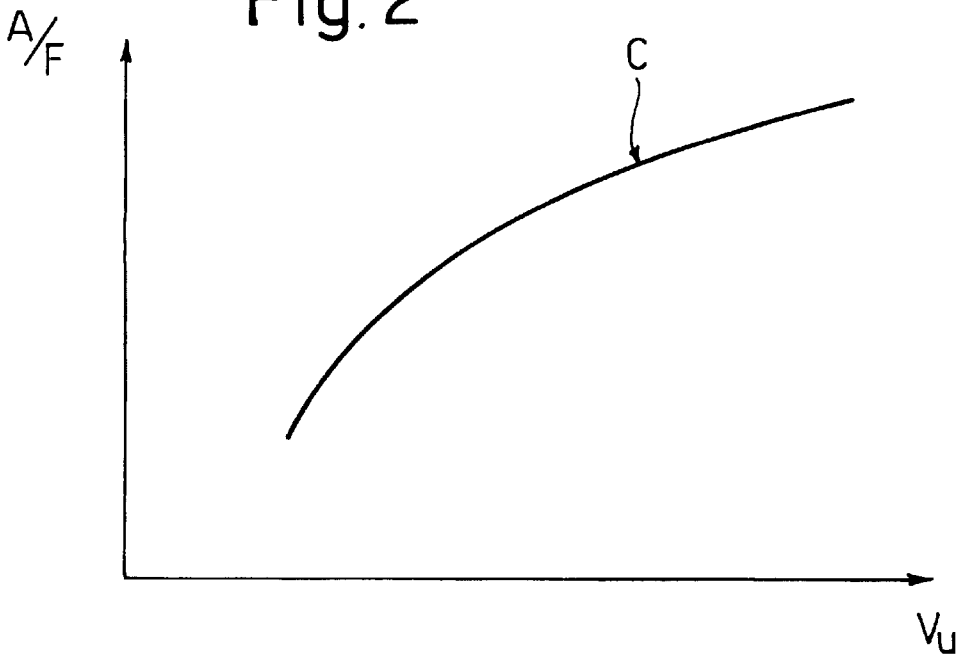
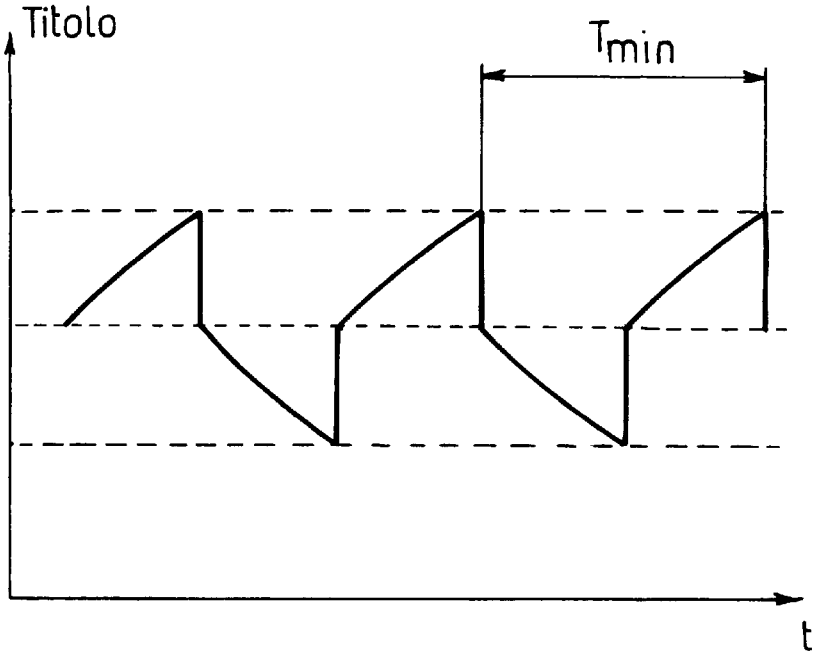
Fig.3

ELECTRONIC DEVICE FOR CONTROLLING THE AIR/FUEL RATIO OF THE MIXTURE SUPPLIED TO AN INTERNAL-COMBUSTION ENGINE

BACKGROUND OF THE INVENTION

The present invention relates to an electronic device for controlling the air/fuel ratio of the mixture supplied to an internal-combustion engine.

Electronic devices for controlling the air/fuel ratio in a closed loop are known, in which an oxygen sensor of the ON/OFF type, advantageously consisting of a lambda probe and arranged in the exhaust manifold of an internal-combustion engine (in particular a petrol engine), generates a bistable feedback signal, the state of which depends on the relationship existing between the air/fuel ratio of the mixture supplied to the engine and the stoichiometric air/fuel ratio.

In particular, lambda probes of the known type are designed to generate a first output voltage, for example ranging between 450 and 900 mVolt, when the mixture supplied to the engine has more fuel than is required by the stoichiometric ratio (rich state) and a second output voltage, for example ranging between 100 and 450 mVolt, when the mixture supplied to the engine has less fuel than is required by the stoichiometric ratio (lean state). Control devices of known type are designed to supply the feedback signal to a processing circuit, in particular a proportional integral (P.I.) circuit which generates at its output a correction parameter KO2 which is used to modify, in a closed loop, the value of a parameter calculated in an open loop and representing a quantity of fuel to be injected. Known ratio control devices produce, by means of the feedback of the signal generated by the lambda probe, an oscillation of the air/fuel ratio actually supplied to the engine about the stoichiometric value; this oscillation takes place within a predetermined range defined by upper and lower limits and allows correct operation of the catalytic converter arranged along the exhaust pipe downstream of the lambda probe.

Linear oxygen sensors, for example so-called UEGOs (Universal Exhaust Gas Oxygen Sensors), designed to generate at their output a signal proportional to the concentration of oxygen present in the exhaust gases, are also known.

SUMMARY OF THE INVENTION

The object of the present invention is to provide an electronic device for controlling the ratio in a closed loop which uses, for generation of a feedback signal, the signal produced by a linear oxygen probe and at the same time is able to operate with a catalytic converter normally used in combination with electronic devices for controlling the air/fuel ratio using oxygen probes of the ON/OFF type.

According to the present invention an electronic device for controlling the air/fuel ratio of the mixture supplied to an internal-combustion engine of the type described in claim 1 is provided.

The present invention also relates to a method for controlling the air/fuel ratio of the mixture supplied to an internal-combustion engine of the type described in claim 7.

BRIEF DESCRIPTION OF THE DRAWINGS

The invention will now be described with reference to the accompanying drawings which illustrate a non-limiting example of an embodiment thereof, in which:

FIG. 2 illustrates a Cartesian diagram of a characteristic of an element forming the device according to FIG. 1;

FIG. 3 shows the pattern, over time, of a parameter controlled by the device according to FIG. 1.

DETAILED DESCRIPTION OF THE INVENTION

Figure 1:
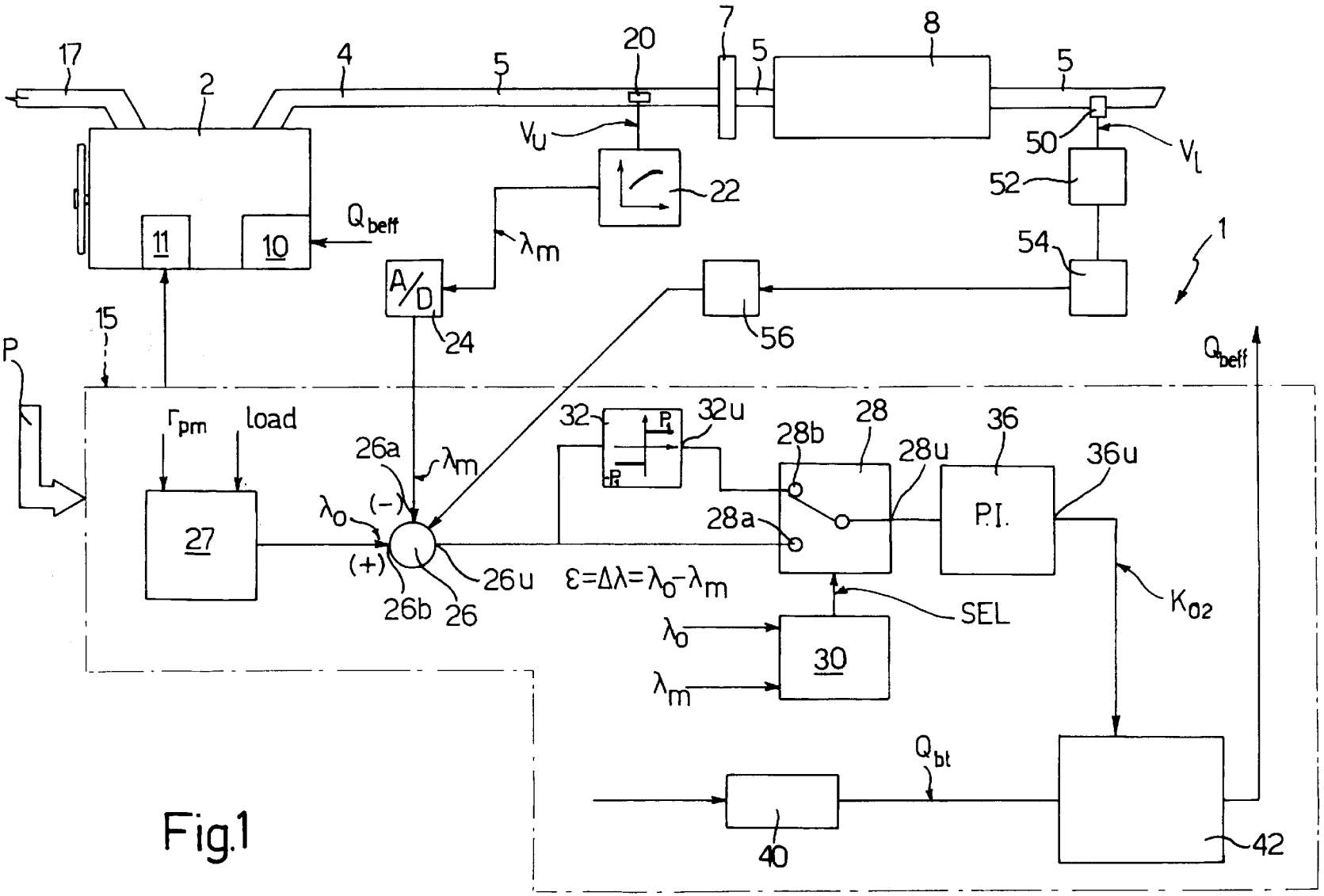
FIG. 1 illustrates schematically an electronic device for controlling the air/fuel ratio of the mixture supplied to an internal-combustion engine constructed in accordance with the principles of the present invention.

In FIG. 1, 1 denotes, in its entirety, an electronic device for controlling the air/fuel ratio of the mixture supplied to an internal-combustion engine 2, in particular a petrol engine (shown schematically).

The engine 2 has an exhaust manifold 4 communicating with a pipe 5 for discharging the exhaust gases, along which a precatalyser 7 and a catalytic converter 8 are arranged. The internal-combustion engine 2 is provided with a fuel injection system 10 (of known type and shown schematically) and an ignition system 11 (of known type and shown schematically) controlled by an electronic engine control unit 15 (shown schematically) receiving at its input information signals P measured in the engine (for example number of rpm, pressure in the intake manifold 17 of the engine and/or air throughput, temperature of the engine coolant, butterfly valve position, etc.) together with information signals outside the engine (for example position of accelerator pedal, information signals from the vehicle gearbox, etc.).

According to the present invention, the electronic control unit 15 co-operates, among other things, with a linear oxygen sensor 20 arranged on the exhaust pipe 5 between the exhaust manifold 4 and the precatalyser 7 upstream of the catalytic converter 8. The linear oxygen sensor 20, advantageously consisting of an UEGO probe, is designed to generate at its output a signal (voltage Vu or current Iu) proportional to the concentration of oxygen in the exhaust gases; the signal (Vu or Iu) is supplied to a conversion circuit 22 in which this signal is converted into a value denoting the air/fuel ratio of the mixture supplied to the engine 2 by means of a characteristic C (FIG. 2). The value of the air/fuel ratio A/F is moreover divided by the value of the stoichiometric air/fuel ratio (14.57) so that the conversion circuit 22 generates at its output a parameter λm (representing the ratio measured) defined as:

$$\lambda m = \frac{(A/F)\text{meas.}}{(A/F)\text{stoich.}}$$

where (A/F)meas. represents the value of the air/fuel ratio measured by the sensor 20 and obtained by means of the characteristic C and (A/F)stoich. represents the value of the stoichiometric air/fuel ratio equivalent to 14.57. In particular, if the value of the parameter λm exceeds unity (λm>1), the air/fuel ratio is greater than the stoichiometric ratio, i.e. an insufficient quantity of fuel is present (lean state), whereas if the value of the parameter λm is less than unity (λm<1) the air/fuel ratio is less than the stoichiometric ratio, i.e. an excessive quantity of fuel is present (rich state).

The conversion circuit 22 communicates at its output with the input of an analog/digital converter 24 communicating at its output with a subtraction input 26*a* of a node 26 to which the digitized value of the measured parameter λm is supplied. The node 26 also has an adder input 26*b* which is supplied with the (digitized) value of a target parameter λo (representing a target air/fuel ratio which one wishes to obtain), defined as:

$$\lambda o = \frac{(A/F)\text{target}}{(A/F)\text{stoch.}}$$

where (A/F)target represents a target value of the air/fuel ratio which one wishes to obtain and (A/F)stoich. represents the value of the stoichiometric air/fuel ratio equivalent to 14.57. The parameter λo is generated at the output by a calculating circuit 27, advantageously an electronic table which selects a stored value of the parameter λo stored on the basis of a plurality of input parameters measured in the engine 2, for example speed of rotation (rpm) of the engine, value of the load applied to the engine, etc. The adder node 26 therefore generates at its output an error ϵ defined by the difference Δλ between the measured value Δm of the standardized air/fuel ratio and the desired value λo of the standardized air/fuel ratio, i.e. Δλ=(λo−λm).

The output 26*u* of the node 26 communicates directly with a first input 28*a* of a selector device 28 having a second input 28*b* and a common output 28*u* communicating with the input of a processing circuit 36, in particular a proportional integral (P.I.) circuit having an output 36*u* where, during use, a correction parameter KO2 is present.

The first and the second inputs 28*a*, 28*b* are designed to communicate alternately with the output 28*u* on the basis of the value of a control signal SEL supplied to the selector device 28 by a control device 30. In particular, the control device 30 receives at its input the values of the parameters λo and λm and is designed to generate a command SEL for establishing the connection between the input 28*b* and the output 28*u* when both the following inequalities are satisfied:

$$S_1<\lambda o<S_2$$

$$S_3<|\lambda o-\lambda m|<S_4$$

where $S_1$, $S_2$, $S_3$ and $S_4$ are preset threshold values stored in the device 30. The control device 30 is also designed to generate a command SEL for establishing the connection between the input 28*a* and the output 28*u* when at least one of the aforementioned inequalities is not satisfied.

The output 26*u* of the node 26 communicates with the input of a saturation circuit 32 having an output 32*u* communicating with the input 28*b* of the selector device 28.

The saturation circuit 32 is designed to provide, for positive input-signal values, a constant positive saturation value P1 and, for negative input signal values, a constant negative saturation value −P1. The saturation values P1 and −P1 generated by the circuit 32, moreover, model the bistable output signal bistable generated by an oxygen sensor (lambda probe) of the ON/OFF type which, as is known, generates at its output a first voltage value when the air/fuel ratio exceeds the stoichiometric value and a second voltage value when the air/fuel ratio is less than the stoichiometric value.

The electronic control unit 15 also comprises a calculation circuit 40 (advantageously consisting of an electronic table) which receives at its input at least some of the information signals P and generates at its output, in response to the inputs and in an entirely known manner, a theoretical value Qbt for the quantity of fuel which the injection system 10 should inject in order to obtain optimum operation of the engine 2. The theoretical value Qbt of the quantity of fuel to be injected is supplied to a correction circuit 42 which is designed to modify this theoretical value calculated in a closed loop and on the basis of information signals measured mainly in the engine 2; the correction carried out on the theoretical value Qbt may be performed (in a known manner) on the basis of a plurality of parameters which take into account, for example, the feedback signal produced by the UEGO probe 20, the dynamic variation in the layer of fuel deposited on the walls of the manifold (fluid film effect), the voltage of the vehicle battery (not shown), etc. In the description which follows, reference will be made, for the sake of simplicity, to a correction performed only as a function of the feedback signal of the UEGO probe 20, it being obvious, however, that the correction performed by the circuit 42 is normally much more complex. In the embodiment shown the correction parameter KO2 present at the output 36*u* of the circuit 36 is supplied to the correction circuit 42 where this parameter is used for calculation of a corrected value Qbeff of the quantity of fuel to be injected, multiplying the theoretical value Qbt by the correction parameter KO2, i.e.:

Qbeff=Qbt KO2

The corrected value Qbeff is also supplied to the injection system 10 in order to physically supply the engine 2 with the quantity of fuel Qbeff.

During use, the theoretical value Qbt calculated by the circuit 40 is supplied to the circuit 42 which corrects the value Qbt in a known manner and on the basis of the correction parameter KO2, generating the corrected value Qbeff supplied to the ignition system 11.

According to the present invention, calculation of the correction parameter KO2 is performed using two methods, referred to respectively as the oscillating method and the zero-error method, which are used alternately. The oscillating method is used when the following inequalities are satisfied:

$$S_1<\lambda o<S_2$$

$$S_3<|\lambda o-\lambda m|<S_4$$

i.e. when the desired target parameter λo lies within a range defined by two limit values ($S_1$, $S_2$) and the error Δλ lies within a range defined by two limit values ($S_3$, $S_4$). In other words, the oscillating method is used when the target parameter λo is substantially stoichiometric and the error Δλ is not too great (i.e. the measured parameter λm does not diverge substantially from the target parameter required λo). According to this method, the error Δλ is supplied to the circuit 32 which models the bistable output signal of a lambda probe, i.e. the parameter λm directly proportional to the air/fuel ratio measured in the pipe 5 is replaced by a dummy bistable value (P1,−P1 ), effectively simulating the operation of a lambda probe normally used in combination with the catalytic converter 8: when the error Δλ is greater than zero, the positive saturation value P1 is generated and when the error Δλ is less than zero, the negative saturation value −P1 is generated.

The signal present at the output 32*u* of the circuit 32, which can be equated, as already mentioned, to the bistable signal generated by a lambda probe of the ON/OFF type, is supplied to the circuit 36 by means of the selector device 28 and is then multiplied by a proportional term Kp and integrated using an integration constant Ki generating (basically in a known manner, which is therefore not described in detail) at the output of the circuit 36 the correction parameter KO2 used in a known manner for correction of the theoretical value Qb of the quantity of fuel. The oscillating control method described above forces oscillations of the air/fuel ratio as measured upon discharge (FIG. 3), having a frequency and amplitude such as to maximize the efficiency of the catalyser 8.

The zero-error method is used when the following inequalities are not satisfied:

$$S_1<\lambda o<S_2$$

$$S_3<|\lambda o-\lambda m|<S_4$$

i.e. when the desired target parameter λo is not stoichiometric and/or the error Δλ is above or below the range defined by the limit values ($S_3$, $S_4$). In particular, the zero-error method is used when the error Δλ is too great (i.e. the measured parameter λm diverges substantially from the target parameter λo). With this method, the error Δλ is supplied directly to the circuit 36 via the selector device 28 (without the intervention of the circuit 32) and is multiplied by a proportional term Kp and integrated using an integration constant Ki generating at the output of the circuit the correction parameter KO2 which rapidly increases with the increase in the error Δλ. The correction parameter KO2 generated by the circuit 36 is used for correction of the theoretical value Qb of the quantity of fuel. The controlling action of the zero-error method tends to cancel out the instantaneous error between the target parameter λo and the measured parameter λm; this control results in a non-oscillatory approach of the air/fuel ratio measured upon discharge to the target air/fuel ratio.

The transitions from one control method to the other are handled so as to ensure that the target ratio required is adapted without producing appreciable variations in torque.

Finally, it is obvious that modifications and changes may be made to the device described without thereby departing from the protective scope of the present invention.

The device 1, for example, could also comprise an auxiliary oxygen sensor 50 (lambda probe) arranged on the exhaust pipe 5 downstream of the catalytic converter 8 and designed to generate a bistable signal V1 which, after being processed by a conversion and filtering circuit (of known type), is digitized by an analog/digital conversion circuit 54 and supplied to a processing circuit 56. The processing circuit 56 may advantageously consist of a proportional integral (P.I.) circuit designed to generate at its output a correction signal supplied to a further adder input of the node 26. The lambda probe 50 forms a further control loop, outside the control loop comprising the linear sensor 20, which allows overall control of the ratio to be improved by offsetting any drift introduced by the control system comprising the linear sensor 20.

The block 32, moreover, could be divided up into a first and a second block; the first and the second block each receiving at their inputs the error signal from the output **26*u* and generating at the output first and second signals supplied to the proportional integral circuit 36 which applies to the said first signal the proportional term Kp and to the second signal the integral conversion distinguished by the integral term Ki so as to generate the correction parameter KO2 at the output. The first and the second locks perform transfer functions between one another, similar to the type of transfer function performed by the saturation circuit 32**.

We claim:

1. Electronic device for controlling an air/fuel ratio of a mixture of air and fuel supplied to an internal-combustion engine (2), characterized in that it comprises:

linear oxygen sensor means (20) arranged on a gas exhaust pipe (5) of the said engine (2) upstream of a catalytic converter (8) on the pipe (5);

converter means (22, 24) for receiving a signal generated by the said linear oxygen sensor means (20) to generate at an output of the converter means a measured parameter (λm) representing the air/fuel ratio of the mixture supplied to the said engine (2);

setting means (27) for receiving information signals measured at least partially in the said engine for generating at its output a target parameter (λo) representing a desired air/fuel ratio;

comparison means (20) for receiving said measured parameter (λm) and said target parameter (λo) and providing at its output an error parameter representing a difference between said measured parameter (λm) and said target parameter (λo;

bistable probe simulator means (32) having an input for receiving said error parameter to generate alternately at an output of the bistable probe simulator means, a dummy signal comprising a positive saturation value (−P1 ) and a negative saturation value (−P1 ) which correspond to a bistable output of an oxygen sensor of ON/OFF type;

processing means (36) communicating at its input with the output of the said bistable probe simulator means (32) for calculating, on the basis of said dummy signal, a correction parameter (KO2) to be applied to a theoretical value (Qb) denoting a calculated quantity of fuel (40) so as to obtain a corrected quantity of fuel (Qbt) to be supplied by a fuel injection system (10) of the said engine (2).

2. Device according to claim 1, characterized in that it comprises bistable selector means (28) for providing alternately, first and second operating modes in which;

in said first operating mode, said error parameter is supplied to the bistable probe simulator means (32) so that said processing means (36) provides a correction parameter on the measured air/fuel ratio to maximize efficiency of the said catalytic converter (8); said correction parameter having an oscillating characteristic of determined frequency and amplitude;

in said second operating mode said error parameter is supplied directly to the said processing means (36) to provide a further correction parameter (KO2) applied to a theoretical value (Qb) of a calculated quantity of fuel (40) so as to obtain a corrected quantity of fuel (Qbt) for said fuel injection system (10) of the said engine(2).

3. Device according to claim 2, characterized in that said selector means (28) activates said first operating mode when both the following relationships are satisfied:

$$S_1<\lambda o<S_2$$

$$S_3<|\lambda o-\lambda m|<S_4$$

where λo and λm represent respectively said target parameter and said measured parameter and $S_1$, $S_2$, $S_3$ and $S_4$ are threshold values;

said selector means (28) activating the said second operating mode when said relationships are not satisfied.

4. Device according to claim 1, characterized in that said processing means (34) comprise a proportional integral circuit.

5. Device according to claim 1, characterized in that said conversion means (22) produces an output signal having a characteristic (C) to convert the signal (Vu) of the said linear oxygen sensor means (20) to a value of said measured parameter representing an air/fuel ratio standardized with respect to a stoichiometric value of the air/fuel ratio.

6. Device according to claim 1, characterized in that it comprises auxiliary oxygen sensor means (50) arranged on the exhaust pipe (5) downstream of the said catalytic converter (8) for producing a substantially bistable signal (V1) supplied to further processing means (52, 54, 56) generating at their output a correction signal supplied to a further input of said comparison means (26).

7. Method for controlling the air/fuel ratio of a fuel mixture supplied to an internal-combustion engine (2), characterized in that it comprises the steps of:

detecting by means of linear oxygen sensor means (20) arranged on a gas exhaust pipe (5) of the said engine upstream of a catalytic converter (8) arranged along the pipe (5) a signal representing the stoichiometric composition of the exhaust gases;

converting (22, 24) said signal representing the stoichiometric composition into a measured parameter (λm) representing the air/fuel ratio of the mixture supplied to the said engine (2);

calculating a target parameter (λo) representing a desired air/fuel ratio;

comparing (26) said measured parameter (λm) with said target parameter to provide an error parameter;

generating, on the basis of the said error parameter, a dummy signal comprising a positive saturation value (P1 ) and a negative saturation value (−P1 ) which correspond to a bistable output of an oxygen sensor of ON/OFF type; and processing (36) said dummy signal to calculate a correction parameter (KO2) to be applied to a theoretical value (Qb) of a calculated quantity of fuel (40) to provide a corrected quantity of fuel (Qbt) for supply to a fuel injection system (10) of the said engine (2).

8. Method according to claim 7, characterized in that it comprises selecting a first and a second mode of operation alternative to one another in which:

said first operating mode comprises the said step of generating, on the basis of the said error parameter, said dummy signal used to calculate said correction parameter which provides oscillations of said measured parameter representing air/fuel ratio, said oscillations having a frequency and amplitude to maximize efficiency of the said catalytic converter (8);

said second operating mode comprises the step of calculating directly, on the basis of the said error parameter, a further correction parameter (KO2) to be applied to a theoretical value (Qb) of a calculated quantity of fuel (40) so as to obtain a corrected quantity of fuel (Qbt) to be supplied by a fuel injection system (10) of the said engine (2).

9. Method according to claim 8, characterized in that selection of said first operating mode is performed if the following relationships are satisfied;

$$S_1<\lambda o<S_2$$

$$S_3<|\lambda o-\lambda m|<S_4$$

where λo and λm represent respectively said target parameter and said measured parameter and $S_1$, $S_2$, $S_3$ and $S_4$ are threshold values; said second operating mode being performed if said relationships are not satisfied.

10. Method according to claim 7, characterized in that it comprises an auxiliary measuring step in which a percentage of oxygen (50) in the gases emerging from the catalytic converter (8) is monitored by means of a lambda probe generating a substantially bistable signal (VI);

said method further comprising the step of processing (52, 54, 56) said substantially bistable signal (VI) so as to generate a further correction signal used in said comparing step.

* * * * *